US008056153B2

(12) United States Patent
Ruedas

(10) Patent No.: US 8,056,153 B2
(45) Date of Patent: Nov. 15, 2011

(54) MULTIPURPOSE URINAL ATTACHMENT

(76) Inventor: Javier Fernando Ruedas, Walnut, CA (US)

( * ) Notice: Subject to any disclaimer, the term of this patent is extended or adjusted under 35 U.S.C. 154(b) by 701 days.

(21) Appl. No.: 12/166,324

(22) Filed: Jul. 2, 2008

(65) Prior Publication Data

US 2009/0070923 A1 Mar. 19, 2009

Related U.S. Application Data

(60) Provisional application No. 60/973,686, filed on Sep. 19, 2007.

(51) Int. Cl.
*E03D 13/00* (2006.01)

(52) U.S. Cl. ..... 4/309; 4/310; 4/222; 4/222.1

(58) Field of Classification Search ..... 4/309–310, 4/222, 222.1, 658, 300.3
See application file for complete search history.

(56) References Cited

U.S. PATENT DOCUMENTS

| | | | | |
|---|---|---|---|---|
| 5,313,672 | A | 5/1994 | Luedtke et al. | |
| 6,055,681 | A * | 5/2000 | Lyons | 4/300.3 |
| 6,081,937 | A * | 7/2000 | Whitacre | 4/300.3 |
| 2004/0034909 | A1 * | 2/2004 | Grueser | 4/300.3 |
| 2004/0197297 | A1 * | 10/2004 | Pays et al. | 424/70.31 |
| 2005/0144711 | A1 | 7/2005 | Valadez et al. | |
| 2007/0044221 | A1 | 3/2007 | Wise, Sr. | |
| 2007/0151009 | A1 * | 7/2007 | Conrad et al. | 4/300.3 |
| 2008/0083064 | A1 * | 4/2008 | Litwhiler | 4/657 |

FOREIGN PATENT DOCUMENTS

JP 2005-240526 A 9/2005

* cited by examiner

*Primary Examiner* — Gregory Huson
*Assistant Examiner* — Karen L Younkins
(74) *Attorney, Agent, or Firm* — QuickPatents, Inc.; Kevin Prince

(57) ABSTRACT

Disclosed herein is an apparatus for advertising a product or service and for sanitizing, deodorizing, and preventing splatter of fluids discharged in a urinal. The apparatus comprises a fluid permeable receptacle herein referred to as "receptacle" suspended along its longitudinal axis for absorbing discharged fluids and releasing the absorbed fluids into a drain of the urinal, an advertisement layer, and fasteners for fastening the receptacle to the urinal. The receptacle comprises particulate material embedded within compartments of the receptacle. The particulate material comprises an anti-splatter material for preventing splatter of fluids, an odor removal material for removing undesired odor from the fluids, and a sanitizing material for cleaning and disinfecting the fluids. Grommets along with the fasteners may be used for fastening the receptacle to the urinal. Advertisements may be printed on the surface of the receptacle or the advertisement layer.

20 Claims, 4 Drawing Sheets

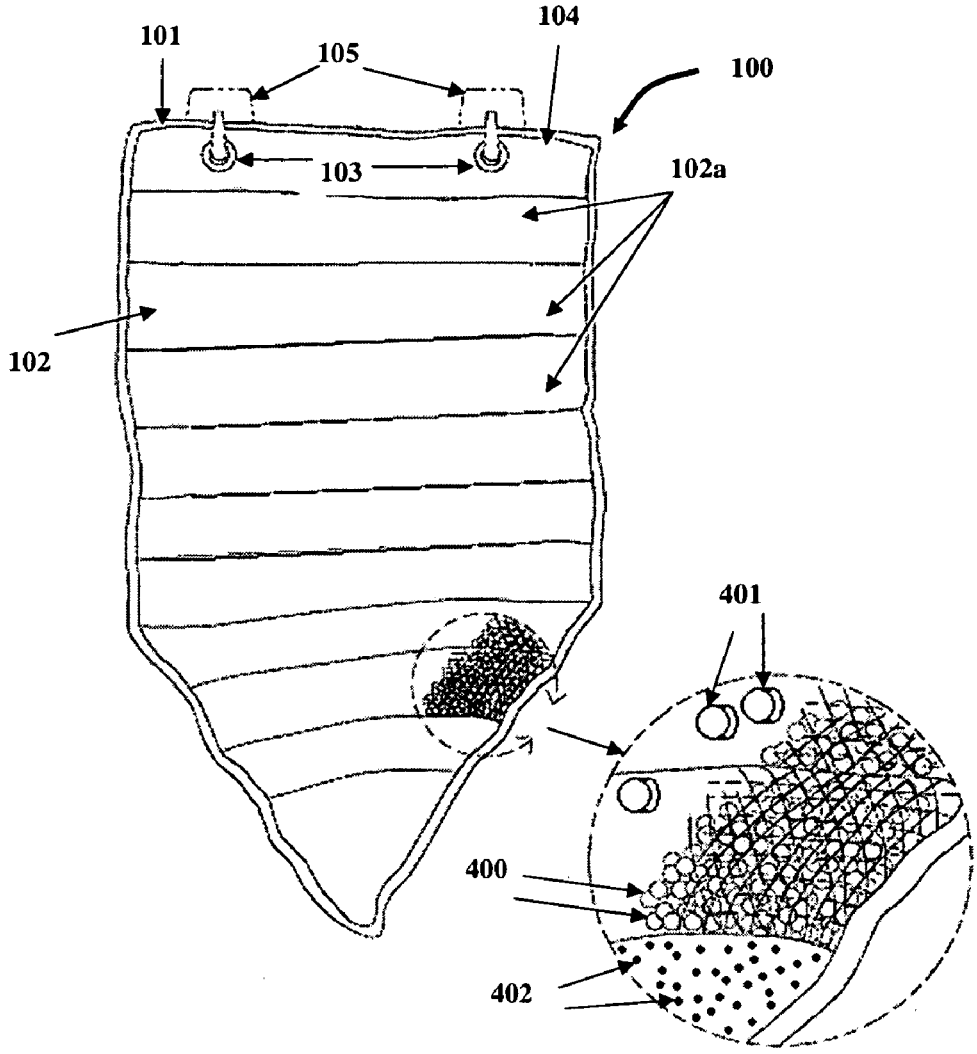
FIG. 3
FIG. 4
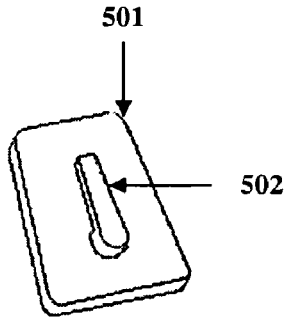
FIG. 5

MULTIPURPOSE URINAL ATTACHMENT

CROSS REFERENCE TO RELATED APPLICATIONS

This application claims the benefit of the provisional patent application 60/973,686 titled "Sanitize Advertise Deodorize, Anti-scatter Urinal design", filed on Sep. 19, 2007 in the United States Patent and Trade Mark Office.

BACKGROUND

This invention, in general, relates to a urinal attachment. More particularly, this invention relates a urinal attachment that is used for sanitizing, advertising, deodorizing, and preventing splashing of fluids discharged in a urinal.

A urinal, in general, comprises a hard, substantially vertical surface down which the urine flows to a sink or other means from where the fluids are discharged. The hard surface of the urinal results in splashing of fluids, for example, flush water, spit, urine, etc., that are discharged at a high velocity into the urinal. When fluids are discharged into the urinal at high velocity, the fluids strike the hard surface of the inner walls of the urinal and splash back outwardly from the interior vicinity of the urinal. The fluids may also splash back and deposit on the inner and outer vicinity of the urinal. A user of the urinal may be the recipient of the splashed fluids that might contain microorganisms that are unsanitary and cause infections. The splashed fluids may also lead to undesirable odor around the urinal. Drains of the urinal may get clogged with insoluble substances that may be discharged by the user, thereby restricting flow of the fluids into the drain and causing urine, etc. to accumulate in the urinal further aggravating the splash back effect.

Conventional urinal screens that typically contain a urinal block, fail to effectively prevent splashing of the fluids. These urinal screens may not effectively deodorize and sanitize the fluids. Moreover, the urinal block may be directly exposed to the flow of fluids. The fluids may dissolve the urinal block quickly due to direct contact with the fluids or the urinal block may disintegrate into chunks and flow into the drain along with the fluids.

Hence, there is a need for a urinal attachment that sanitizes, deodorizes, and prevents splashing of fluids discharged in a urinal. Furthermore, there is a need for a urinal attachment that advertises a product or service and provides advertising messages to the user.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The apparatus disclosed herein addresses the above stated needs for advertising a product or service, and for sanitizing, deodorizing, and preventing splashing of fluids discharged in a urinal. The apparatus further provides advertising messages to the user. The apparatus disclosed herein comprises a fluid permeable receptacle suspended along its longitudinal axis for absorbing fluids discharged on the fluid permeable receptacle. The fluid permeable receptacle further releases the absorbed fluids into a drain of a urinal. The fluids may comprise urine, waste fluid, flush water, spit, blood, urine, etc. The fluid permeable receptacle is subdivided into multiple compartments. The compartments may be oriented in a vertical direction or a horizontal direction. The fluid permeable receptacle comprises particulate material embedded within the compartments for preventing the splatter of fluids. The particulate material comprises an anti-splatter material for preventing the splatter of the fluids, an odor removal material for removing undesired odor from the fluids, and a sanitizing material for cleaning and disinfecting the fluids. The fluid permeable receptacle may be fastened to the urinal using one or more fasteners.

The open end of the fluid permeable receptacle is sealed and comprises multiple holes with an inextensible strip, secured by multiple grommets. The inextensible strip may maintain the shape of the fluid permeable receptacle. The grommets are used for fastening the fluid permeable receptacle to the urinal using the fasteners. The fluid permeable receptacle may comprise advertisements printed on the surface of the fluid permeable receptacle. An advertisement layer may also be attached to the fluid permeable receptacle for advertising a product or service. The advertisement layer provides advertising messages to the user. The advertising messages may be educational messages, motivational messages, inspirational messages, etc. The fluid permeable receptacle covers the urinal and prevents entry of unwanted substances into the drain of the urinal. The fluid permeable receptacle prevents the splashing of the fluids that may impinge on the surface of the fluid permeable receptacle. The fluids are buffered by the particulate material present in the fluid permeable receptacle.

The apparatus disclosed herein accomplishes advertising of a product or service, sanitizing, deodorizing, and preventing splashing of discharged fluids simultaneously. Each of the components of the apparatus performs a well defined unique function, in addition to complementing and enhancing the functions of the other components. The components, in combination, perform a common function as a single apparatus. Furthermore, the apparatus enables efficient, vivid, and inexpensive advertising in a unique manner in addition to being environmentally friendly by using natural non toxic recyclable materials.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

FIG. 3 exemplarily illustrates the internal structure of the apparatus.

FIG. 4 exemplarily illustrates the particulate material contained in the apparatus.

FIG. 5 exemplarily illustrates a fastener used for fastening the apparatus to the urinal.

DETAILED DESCRIPTION OF THE INVENTION

Figure 1:
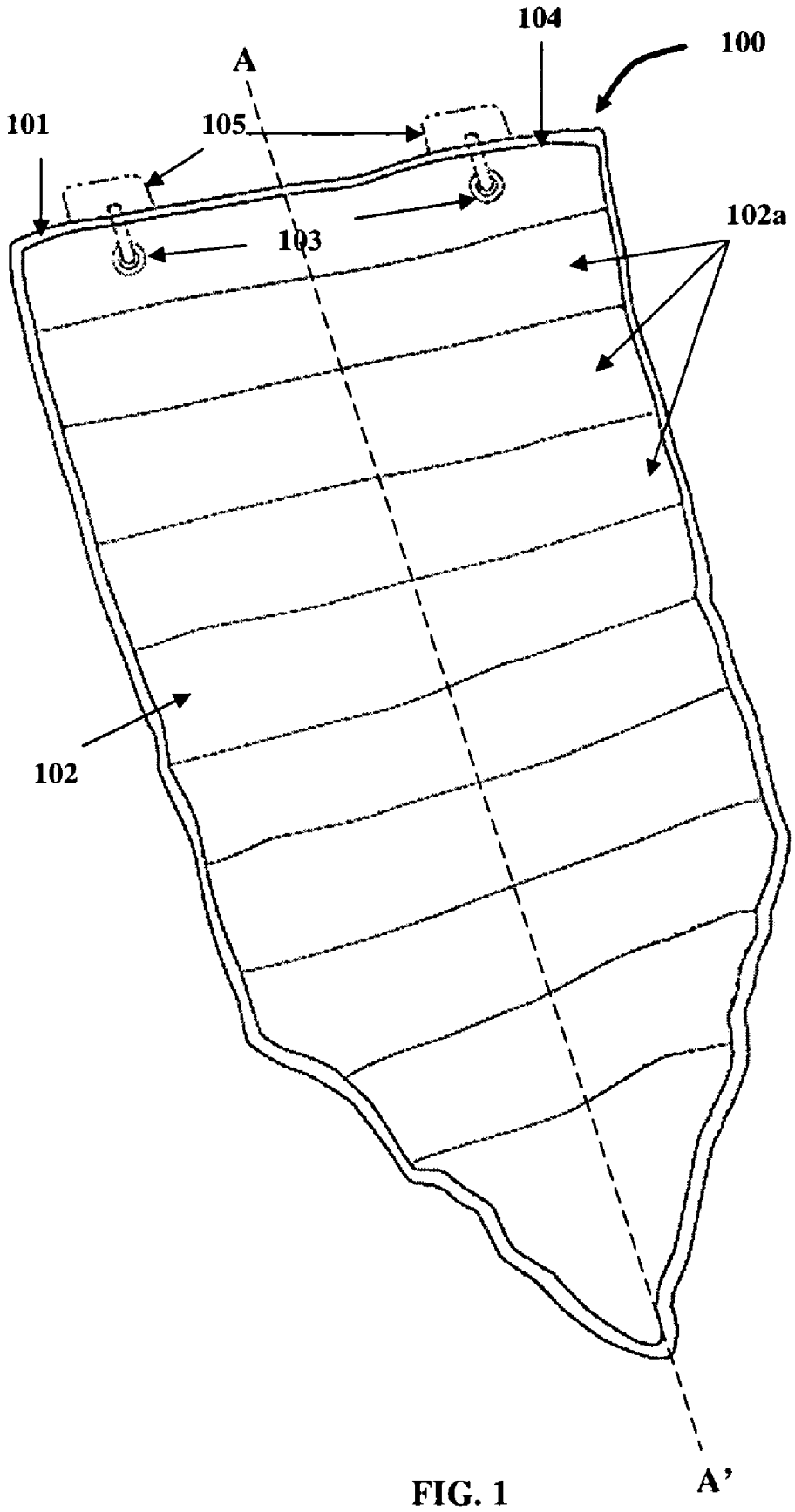
FIG. 1 illustrates an apparatus for advertising a product or service, and for sanitizing, deodorizing, and preventing splatter of fluids on a user from a urinal.
Figure 2:
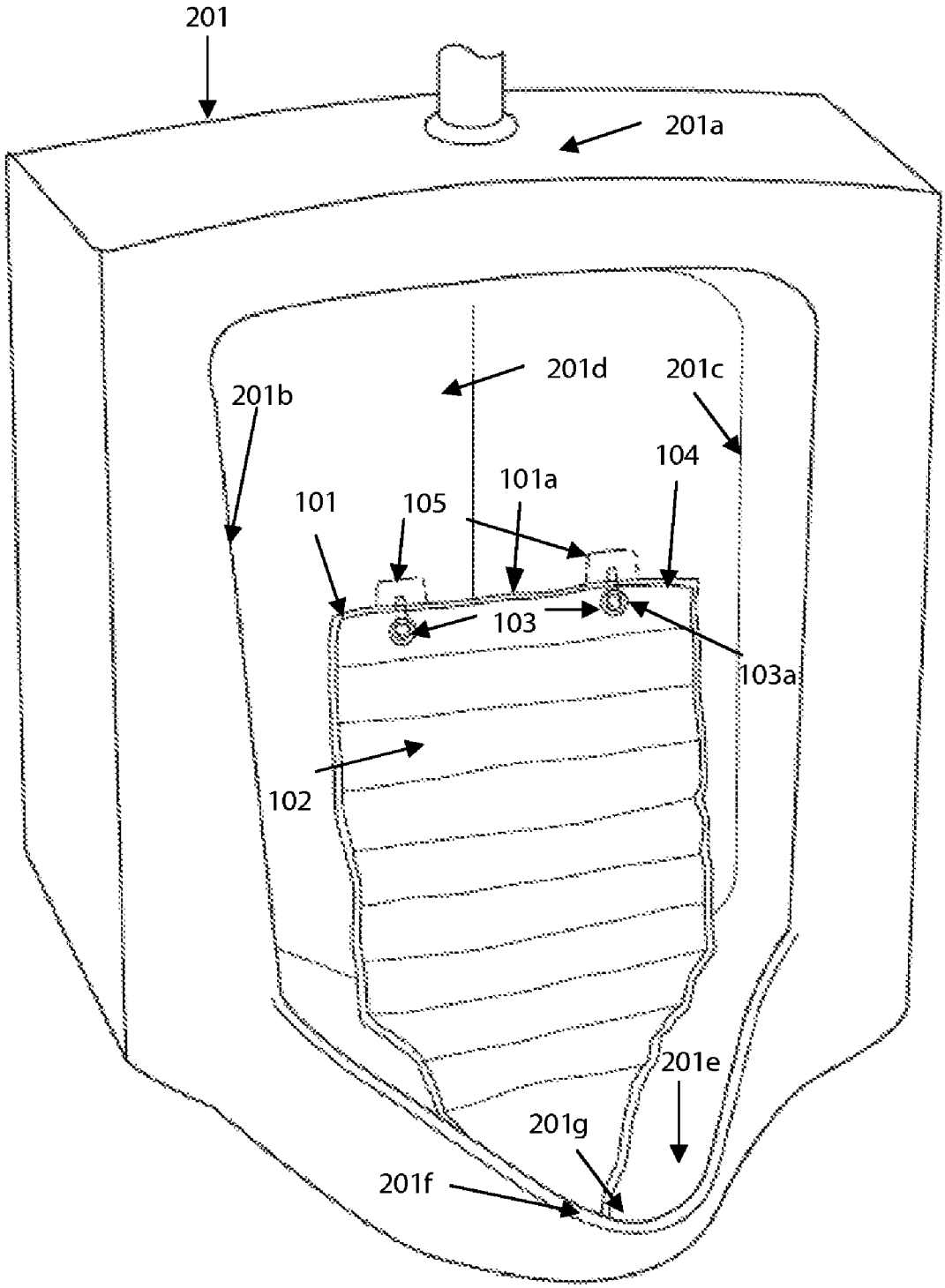
FIG. 2 exemplarily illustrates the apparatus positioned within a urinal.

FIG. 1 illustrates an apparatus 100 for advertising a product or service, and for sanitizing, deodorizing and preventing splatter of fluids on a user from a urinal 201. The apparatus 100 is herein referred to as a "urinal attachment". The urinal attachment 100 comprises a fluid permeable receptacle 102 herein referred to as a "receptacle" suspended along its longitudinal axis in the urinal 201. A and A' represent the longitudinal axis of the receptacle 102. The receptacle 102 is subdivided into multiple compartments 102*a*. The compartments 102*a* may be oriented in a vertical direction or a horizontal direction. The receptacle 102 absorbs fluids discharged on the receptacle 102 and releases the absorbed fluids into a drain (not shown) at the bottom of the urinal 201 as illustrated in FIG. 2. The fluids may comprise urine, waste fluid, flush water, spit, blood, urine, etc. The receptacle 102 comprises particulate material embedded within the compartments 102*a*. The particulate material comprises an anti-splatter material 402, an odor removal material 400, and a sanitizing material 401. The anti-splatter material 402 prevents splatter or splash back of fluids discharged onto the surface of the receptacle 102.

The odor removal material 400 removes undesired odor from the fluids. The odor removal material 400 may be dipped in essential oils. The essential oils provide one or more of fragrance properties, deodorizing properties, disinfecting properties, and antiseptic properties to the odor removal material 400. The odor removal material 400 may impart these properties to the fluids that may come in contact with the odor removal material 400. The sanitizing material 401 sanitizes, disinfects, and cleans the fluids.

Figure 6:
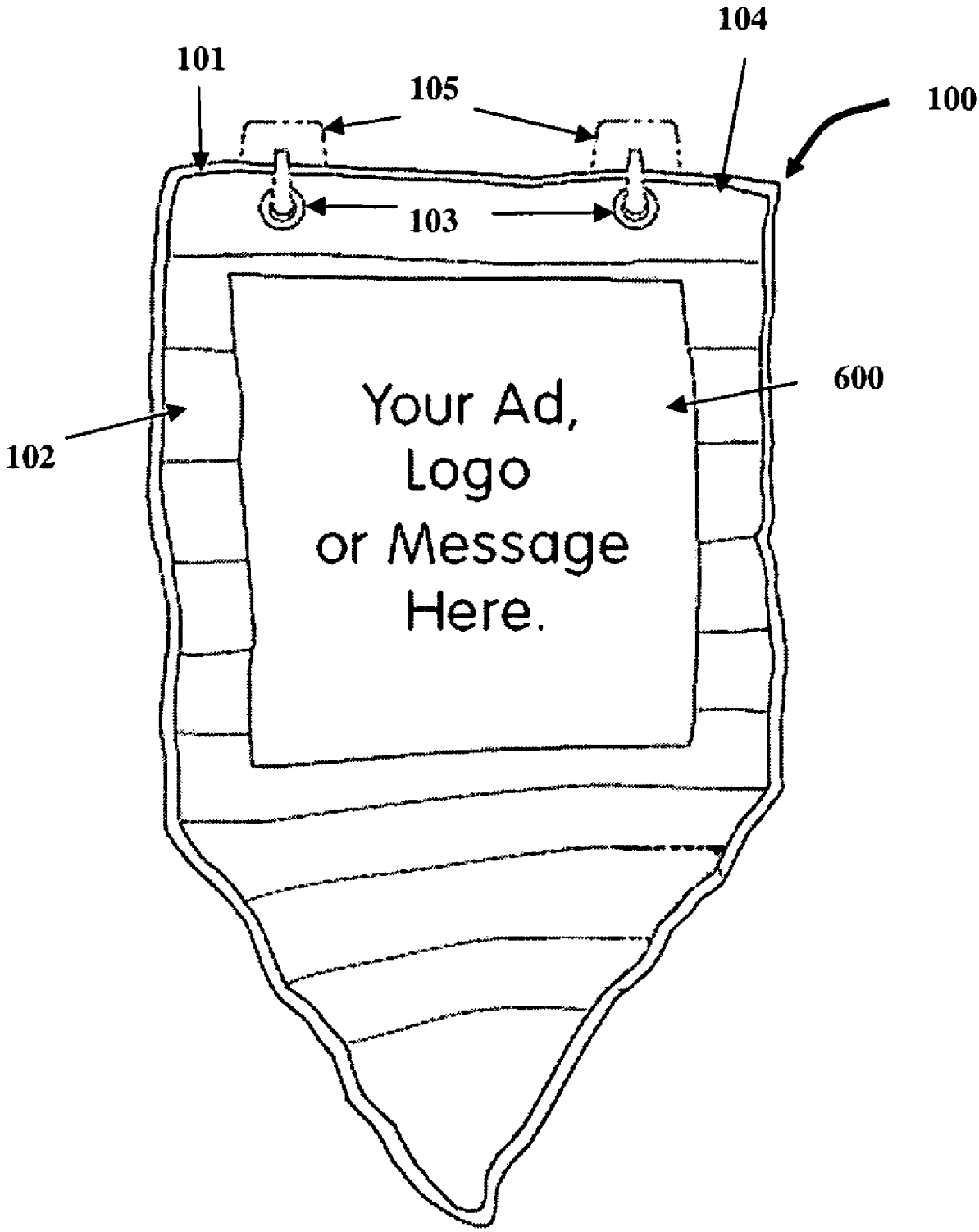
FIG. 6 exemplarily illustrates the apparatus with an advertisement layer.

The urinal attachment 100 further comprises multiple fasteners 105. The fasteners 105 secure the receptacle 102 to the urinal 201. The fasteners 105, for example may be, suction cups, self adhesive hooks, etc. The open end of the receptacle 102 of the urinal attachment 100 may be sealed to prevent spillage of the particulate material. The receptacle 102 may have any shape and size. The receptacle 102 is impervious to non fluid substances. The urinal attachment 100 further comprises an advertisement layer 600 attached to the receptacle 102. The advertisement may be directly printed on the receptacle 102. The advertisement may also be printed on an advertisement layer 600 attached to the receptacle 102 as illustrated in FIG. 6.

The compartments 102*a* in the urinal attachment 100 may be designed to have any shape and size. The compartments 102*a* may be oriented in a predefined direction. The compartments 102*a* may be oriented in a horizontal direction as illustrated in FIG. 1. The receptacle 102 may contain a predetermined number of compartments 102*a*.

The receptacle 102 may be made of woven fibrous material. The receptacle 102 may also be made of a non woven fibrous material. The density of the woven fibrous material and the non woven fibrous material prevents passage of non fluid substances through the receptacle 102. The woven fibrous material may comprise, for example, plastic, silk, nylon, polyester, cotton, rayon, wool, etc. The woven fibrous material may comprise translucent or opaque materials formed of a semi-rigid or flexible material, for example polyethylene, polypropylene, poly vinyl chloride, poly ethylene terephthalate, various types of synthetic polyester meshes, etc. The receptacle 102 may be sized and adapted to conform to the dimensions of any type of urinal 201.

The receptacle 102 may be made of one or more pieces of organza, for example, polyester, rayon, nylon, silk, cotton, wool, jute, etc. The receptacle 102 may be made of synthetic fibrous material. The synthetic fibrous material may be made of, for example, polyethylene (PE), polypropylene (PP), nylon, polytetrafluoroethylene (PTFE), polyvinyl-chloride (PVC), polyethylene-terephthalate (PET), polyester, etc. The fibers in the synthetic fibrous material may provide varying levels of penetration for the fluids.

FIG. 2 exemplarily illustrates the urinal attachment 100 positioned within a urinal 201. The urinal attachment 100 prevents splatter of fluids outside the urinal 201 and splash back onto the user. The urinal attachment 100 comprises fasteners 105 that may be used for fastening the receptacle 102 to the urinal 201. The urinal 201 comprises an upper section 201*a*, a first sidewall 201*b*, a second sidewall 201*c*, the back wall 201*d*, a bowl section 201*e*, and a lip portion 201*f* that are joined together to form an inner region. In general, the inner region captures discharged fluids, for example, urine, flush water, waste water, spit, etc. The lip portion 201*f* of the urinal 201 inhibits the flow of fluids or splash back of the fluids outside the bowl section 201*e* of the urinal 201. A plumbing device (not shown) is attached to the upper section 201*a* for dispensing water into the urinal 201 to flush the urinal 201.

The bowl section 201*e* of the urinal 201 comprises a drain apparatus (not shown). The bowl section 201*e* provides outlet for at least a portion of waste fluids discharge within the urinal 201 to a sewage plumbing device (not shown). Additionally, a flush regulator (not shown) is attached to the plumbing device to regulate the flow of flush water into the urinal 201. The upper section 201*a*, the back wall 201*d*, the first sidewall 201*b* and second sidewall 201*c* may be adapted to direct the flow of flush water to rinse the urinal attachment 100 and the bowl section 201*e*.

The urinal attachment 100 may be attached to the back wall 201*d* of the urinal 201 to reduce consumption of water used for flushing the urinal 201. The combination of the anti-splatter material 402, the odor removal material 400, and the sanitizing material 401 may substantially increase the usage life of the urinal attachment 100. The fragrance from the odor removal material 400 may provide therapeutic properties useful in aroma therapy. The receptacle 102 may be reusable, recyclable and may comprise an aesthetically pleasing color. The receptacle 102 may be treated with a cleaning agent such as clorox, lysol, hydrogen peroxide, alcohol, and combination of bleach 1/10 and tap water 9/10, etc. The cleaning agent may reduce bacterial growth.

The receptacle 102 of the urinal attachment 100 may cover a drain 201*g* of the urinal 201 to prevent entry of unwanted substances into the drain 201*g*. The unwanted substances may restrict the flow of the fluids into the drain 201*g* of the urinal 201. The unwanted substances might comprise gum, tobacco, and other non fluid substances. When the discharged fluid impinges on the receptacle 102, splashing of the fluid is prevented. The fluid is buffered by the particulate material present in the receptacle 102.

FIG. 3 exemplarily illustrates an internal structural view of the urinal attachment 100. The particulate material contained in the urinal attachment 100 is exemplarily illustrated in FIG. 4. The particulate material comprises the anti-splatter material 402, the odor removal material 400, and the sanitizing material 401. The anti-splatter material 402 present in the receptacle 102 may exemplarily comprise silica, pumice, or a water soluble chemical compound, for example, sodium perborate tetra hydrate, etc. The anti-splatter material 402 absorbs at least a portion of the fluids that are discharged on the receptacle 102, thereby reducing splashing of the discharged fluids on the user and the outer portion of the urinal 201. The absorbed fluids may then come in contact with the odor removal material 400 and the sanitizing material 401. The anti-splatter material 402 further suppresses noise created when the discharged fluids contact the surface of receptacle 102, thereby providing noise attenuation around the urinal 201.

The odor removal material 400 present in the receptacle 102 may be dipped in essential oils. The essential oils may provide one or more of fragrance properties, deodorizing properties, disinfecting properties, and antiseptic properties to the odor removal material 400. The odor removal material 400 may disinfect, deodorize, and antisepticise the fluids that contact the odor removal material 400. The odor removal material 400 removes undesired odor from the fluids and impart a pleasant fragrance. The odor removal material 400 may be adapted to have any shape and size. The odor removal material 400 may further reduce splatter of fluids on the user and filter the fluids from non fluid substances. The odor removal material 400 may be one or more of beads, tablets, briquettes, granules, pellets, and dispensers. The odor removal material 400 may either be soluble or insoluble in the fluids. Different receptacles may be manufactured to contain different types of odor removal materials, with each type of odor removal material 400 having a unique fragrance. The fragrance provided by the odor removal material 400 may provide benefits of aroma therapy, thereby providing a pleasant odor around the urinal 201. The fragrance provided by the odor removal material 400 may provide a relaxed feel to the user.

The odor removal material 400 may exemplarily be aroma beads. The odor removal material 400 may comprise different types of fragrance combinations. The fragrance material may remove undesired odor from the fluids that may come in contact with the odor removal material 400.

The sanitizing material 401 present in the receptacle 102 may comprise one or more of sanitizing beads, sanitizing urinal blocks, sanitizing tablets, sanitizing briquettes, sanitizing granules, sanitizing pellets, and sanitizing dispensers. The sanitizing material 401 present in the receptacle 102 may also comprise one of sanitizing powder, sanitizing crystals, and sanitizing enzymes. The enzymes may comprise bacterial spores, comprising sanitizing urinal blocks free from paradichlorobenzene (PARA), for example, Fragrance Master Para Free Urinal Block, manufactured by Odorite® International. The sanitizing material 401 may also be undyed. Further, the sanitizing material 401 may be non aromatic or odorless. The sanitizing material 401 present in the receptacle 102 sanitizes the fluids. The sanitizing material 401 minimizes the presence of undesirable organisms in the fluids and within the urinal 201. The sanitizing material 401 may either be soluble or insoluble in the fluids. The sanitizing material 401 may completely deactivate the organisms present in fluids and the urinal 201.

The sanitizing material 401 may exemplarily comprise sanitizing urinal blocks free from paradichlorobenzene, for example, Fragrance Master Para Free Urinal Block, manufactured by Odorite® International. The urinal block may be odorless and undyed. In another example, the sanitizing material 401 may comprise multiple sanitizing beads. The sanitizing beads may be made of fluid insoluble material, containing a sanitizing material.

The receptacle 102 is sealed to prevent spillage of the particulate material. A seal 104 may be applied to the open end and to each of the compartments 102*a* of the receptacle 102 by one of sewing, heat sealing, stapling, and gluing. The seal 104 may either be removable or non removable. The removable seal may comprise a zipper, a hook, and a loop fastener, etc. The removable seal may be removed to replenish the used anti-splatter material 402, sanitizing material 401, and the odor removal material 400. The receptacle 102 may be sealed by sewing, heat sealing, stapling, or gluing.

In one embodiment of the urinal attachment 100 disclosed herein, a mounting end 101*a* may comprise multiple holes 103*a*. The mounting end 101*a* of the receptacle 102 may comprise an inextensible strip 101 with multiple holes 103*a* secured by multiple grommets 103. The inextensible strip 101 maintains the structure of the receptacle 102. The inextensible strip 101 may be, for example, plastic. The grommets 103 and the inextensible strip 101 are used for fastening the receptacle 102 to the urinal 201 using the fasteners 105. The holes 103*a*, secured by the grommets 103 present at the mounting end 101*a* may be used to secure the receptacle 102 to back wall 201*d* of the urinal 201.

FIG. 5 exemplarily illustrates a fastener used for fastening the urinal attachment 100 to the urinal 201. The fasteners 105 secure the receptacle 102 to the back wall 201*d* of the urinal 201. The fasteners 105 may be self adhesive hooks attached to the urinal 201. The self adhesive hook comprises a hook 502 attached to one side of a hook plate 501 and a water resistant adhesive strip at the opposite side of the hook plate 501. The adhesive strip may for example comprise one of Adhesive Transfer Tape made by 3M™ or adhesive water resistant strips made by Avery Dennison. The adhesive strip attaches the hook plate 501 to the urinal 201. Suction cups may also be used for fastening the urinal attachment 100 to the urinal 201.

FIG. 6 exemplarily illustrates the urinal attachment 100 with an advertisement layer 600. The advertisement layer 600 provides advertising messages to the user. The advertising messages may be educational messages, motivational messages, inspirational messages, etc. The advertisement layer 600 may comprise a fibrous woven material. The fibrous material may be a water resistant material such as polyethylene (PE), polypropylene (PP), nylon, polytetrafluoroethylene (PTFE), polyvinyl-chloride (PVC), polyethylene-terephthalate (PET), polyester, etc. Advertisements may be printed on the advertisement layer 600 using a waterproof and water resistant ink. The waterproof and water resistant ink may be for example waterproof and water resistant inks manufactured by Hewlett-Packard, Hp®. The printer used to print the advertisements on the advertisement layer 600 or the surface of the receptacle 102 may be, for example, a printer manufactured by Hewlett-Packard, Hp®. The advertisements may comprise logos, images, promos, and other information.

In one example, the dimensions of an exemplary urinal attachment 100 may be as follows. The receptacle 102 may be 8.5 inches wide and 17.5 inches long. The advertisement layer 600 may be 8.5 inches wide and 8.5 inches long.

In one embodiment, the urinal attachment 100 is used in a water free urinal. The anti-splatter material 402 in this example may comprise sodium perborate tetra hydrate and natural non-toxic enzymes. Sodium perborate tetra hydrate comprises disinfecting properties and antiseptic properties.

The receptacle 102 may be constructed as follows. Two pieces of sheer fabric such as organza comprising silk may be sewn around the edges to obtain a sack with an open end. The anti-splatter material 402, the odor removal material 400 and the sanitizing material 401 may be placed inside the compartments 102*a* of the receptacle 102 either individually or as a combination. Compartments 102*a* may be formed by sewing, heat sealing, stapling, or gluing the surfaces of the two pieces of the sheer fabrics with each other. The open end may be sealed with an inextensible strip 101 in between holes present in the open end. Grommets 103 may be used to secure the holes. The receptacle 102 may be permanently sealed by heat sealing the open end. The receptacle 102 may then be secured to the back wall 201*d* of the urinal 201 using the fasteners 105.

The foregoing examples have been provided merely for the purpose of explanation and are in no way to be construed as limiting of the present method and system disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. An apparatus for sanitizing, deodorizing, and preventing splatter of fluids discharged in a urinal on a user, comprising:

a fluid permeable receptacle adapted to be suspended in said urinal for absorbing said fluids discharged in the urinal, wherein said fluid permeable receptacle is adapted to release further said absorbed fluids into a drain of the urinal;

the fluid permeable receptacle subdivided into a plurality of fixed-shaped compartments oriented in a predefined direction, wherein said compartments are oriented in one of a horizontal direction and a vertical direction with respect to a longitudinal axis of the fluid permeable receptacle;

particulate material embedded within the compartments for sanitizing, deodorizing, and preventing said splatter of the fluids discharged in the urinal; and a plurality of fasteners adapted to fasten the fluid permeable receptacle to the urinal;

whereby the fluid permeable receptacle sanitizes, deodorizes, and prevents the splatter of the fluids on said user.

2. The apparatus of claim 1, wherein said particulate material comprises one or more of:

an anti-splatter material for preventing the splatter of the fluids;

an odor removal material for removing undesired odor from the fluids; and a sanitizing material for cleaning and disinfecting the fluids.

3. The apparatus of claim 2, wherein when said particulate material comprises said anti-splatter material, said anti-splatter material is one of silica, pumice and a combination thereof.

4. The apparatus of claim 2, wherein when said particulate material comprises said anti-splatter material, said anti-splatter material is a water soluble chemical compound.

5. The apparatus of claim 2, wherein when said particulate material comprises said odor removal material, said odor removal material is one or more of beads, tablets, briquettes, granules, pellets, and dispensers.

6. The apparatus of claim 2, wherein when said particulate material comprises said odor removal material, said odor removal material is dipped in essential oils, wherein said essential oils provide one or more of fragrance properties, deodorizing properties, disinfecting properties, and antiseptic properties to the odor removal material.

7. The apparatus of claim 2, wherein when said particulate material comprises said sanitizing material, said sanitizing material is one or more of sanitizing beads, sanitizing urinal blocks, sanitizing tablets, sanitizing briquettes, sanitizing granules, sanitizing pellets, and sanitizing dispensers, sanitizing powder, sanitizing crystals, and sanitizing enzymes.

8. The apparatus of claim 2, wherein when said particulate material comprises said sanitizing material, said sanitizing material is undyed and non aromatic.

9. The apparatus of claim 2, wherein when said particulate material comprises said sanitizing material, said sanitizing material is free from paradichlorobenzene.

10. The apparatus of claim 1, wherein said fasteners are self adhesive hooks, wherein said self adhesive hooks comprise water resistant adhesive strips.

11. The apparatus of claim 1, wherein said fasteners are suction cups.

12. The apparatus of claim 1, further comprising an advertisement layer attached to the fluid permeable receptacle for advertising a product or a service.

13. The apparatus of claim 1, wherein a mounting end of the fluid permeable receptacle comprises an inextensible strip and a plurality of holes secured by a plurality of grommets, wherein said grommets and said inextensible strip are adapted to fasten the fluid permeable receptacle to the urinal using said fasteners.

14. The apparatus of claim 13, wherein the inextensible strip maintains structure of the fluid permeable receptacle, wherein the inextensible strip is plastic.

15. The apparatus of claim 1, wherein the fluid permeable receptacle covers said drain of the urinal to prevent entry of unwanted substances into the drain, wherein said unwanted substances restrict flow of the fluids into the drain of the urinal.

16. The apparatus of claim 1, wherein the fluid permeable receptacle is made of one of a woven fibrous material and a non woven fibrous material, wherein a density of said woven fibrous material and said non woven fibrous material prevents passage of non fluid substances through the fluid permeable receptacle.

17. An apparatus for advertising a product or service, and for sanitizing, deodorizing, and preventing splatter of fluids discharged in a urinal on a user, comprising:

a fluid permeable receptacle adapted to be suspended in said urinal for absorbing said fluids discharged in the urinal, wherein said fluid permeable receptacle is adapted to release said absorbed fluids into a drain of the urinal;

the fluid permeable receptacle subdivided into a plurality of fixed-shaped compartments oriented in a predefined direction, wherein said compartments are oriented in one of a horizontal direction and a vertical direction with respect to a longitudinal axis of the fluid permeable receptacle;

particulate material embedded within the compartments adapted to sanitize, deodorize and prevent said splatter of the fluids;

an advertisement layer attached to the fluid permeable receptacle;

a plurality of fasteners adapted to fasten the fluid permeable receptacle to the urinal; and a mounting end of the fluid permeable receptacle comprises an inextensible strip and a plurality of holes secured by a plurality of grommets at a mounting end of the fluid permeable receptacle, wherein said grommets and said inextensible strip are adapted to fasten the fluid permeable receptacle to the urinal using said fasteners;

whereby the fluid permeable receptacle advertises said product or service, sanitizes, deodorizes, and prevents the splatter of the fluids on said user.

18. The apparatus of claim 17, wherein said particulate material comprises one or more of:

an anti-splatter material for preventing the splatter of the fluids;

an odor removal material for removing undesired odor from the fluids; and a sanitizing material for cleaning and disinfecting the fluids.

19. The apparatus of claim 17, wherein said advertisement layer comprises a woven water resistant and recyclable fibrous material, wherein advertisements are printed on the advertisement layer using a waterproof and water resistant ink.

20. The apparatus of claim 19, wherein said advertisements are directly printed on the fluid permeable receptacle using said waterproof and water resistant ink.

* * * * *